US007300134B2

(12) United States Patent
Suzuki

(10) Patent No.: US 7,300,134 B2
(45) Date of Patent: Nov. 27, 2007

(54) IMAGE FORMING APPARATUS AND METHOD FOR HUMIDIFYING IN HEAD CAP

(75) Inventor: Takumi Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 10/971,066

(22) Filed: Oct. 25, 2004

(65) Prior Publication Data

US 2005/0128242 A1 Jun. 16, 2005

(30) Foreign Application Priority Data

Oct. 30, 2003 (JP) ..... 2003-371087
Oct. 5, 2004 (JP) ..... 2004-292933
Oct. 18, 2004 (JP) ..... 2004-303457

(51) Int. Cl.
*B41J 2/165* (2006.01)

(52) U.S. Cl. ..... 347/29; 347/28

(58) Field of Classification Search ..... 347/29, 347/22, 28

See application file for complete search history.

(56) References Cited

U.S. PATENT DOCUMENTS 4,364,065 A * 12/1982 Yamamori et al. ..... 347/28
4,533,927 A * 8/1985 Iwagami et al. ..... 347/29
4,540,997 A * 9/1985 Biggs et al. ..... 347/23
4,746,938 A * 5/1988 Yamamori et al. ..... 347/28
5,055,856 A * 10/1991 Tomii et al. ..... 347/30
5,200,278 A * 4/1993 Watkins et al. ..... 429/24
5,210,550 A * 5/1993 Fisher et al. ..... 347/30
5,673,070 A * 9/1997 Nakanishi et al. ..... 347/19
5,784,081 A * 7/1998 Ozaki et al. ..... 347/30
6,067,101 A * 5/2000 Arakawa et al. ..... 347/19
6,145,952 A * 11/2000 Sharma et al. ..... 347/22
6,168,256 B1 * 1/2001 Sharma et al. ..... 347/28
6,183,057 B1 * 2/2001 Sharma et al. ..... 347/27
6,183,058 B1 * 2/2001 Sharma et al. ..... 347/28
6,293,648 B1 * 9/2001 Anderson ..... 347/29
6,350,007 B1 * 2/2002 Meichle et al. ..... 347/29
6,390,593 B1 * 5/2002 DeRoos et al. ..... 347/31
6,893,119 B2 * 5/2005 Ushiro ..... 347/86
6,905,189 B1 * 6/2005 Duffield ..... 347/28
7,073,897 B2 * 7/2006 Kubokawa ..... 347/86
2003/0128251 A1 * 7/2003 Ujita ..... 347/29
2003/0222929 A1 12/2003 Horigome
2006/0279603 A1 * 12/2006 Kusunoki et al. ..... 347/22

FOREIGN PATENT DOCUMENTS

JP 9-213359 8/1997
JP 10-251484 9/1998
JP 2005032039 A * 2/2005

* cited by examiner

*Primary Examiner*—Stephen Meier
*Assistant Examiner*—Rene Garcia, Jr.
(74) *Attorney, Agent, or Firm*—Fitzpatrick, Cella, Harper & Scinto

(57) ABSTRACT

An image forming apparatus, for ejecting liquid from openings to form an image on a printing medium, includes a head cap for covering the opening surface through which the openings open when a liquid ejection head in which the opening are formed is not in use and for protecting the openings from external air, a rechargeable battery for activating the image forming apparatus, a fuel cell for charging the rechargeable battery, and a liquid path along which water generated as the fuel cell is activated is introduced into the head cap. With this arrangement, when the liquid ejection head is not activated, moisture retention in the head cap can be achieved.

7 Claims, 6 Drawing Sheets

IMAGE FORMING APPARATUS AND METHOD FOR HUMIDIFYING IN HEAD CAP

BACKGROUND OF THE INVENTION

1. Field of the Invention

The present invention relates to an image forming apparatus for ejecting a liquid from an opening formed in a liquid ejection head and forming an image on a printing medium, and a method for humidifying in ahead cap, whereby, when the liquid ejection head is not used, the circumferential edge of the opening is covered in order to protect the opening from external air.

"Printing" described in this specification includes not only the forming of meaningful information, such as characters and figures, on printing media, but also the forming of images, designs and patterns, regardless of whether the data are meaningful or whether the data are visible to a person, and the performance of a process, such as an etching process, for a printing medium.

The term "printing medium" includes not only general purpose paper used for a printing apparatus, but also liquid acceptable media, such as a fabric, resin film, a metal sheet, glass, ceramics, wood and leather, and a three-dimensional object other than a sheet member, for example, a spherical member or a cylindrical member.

The term "liquid" should be interpreted broadly as well as in the definition for "printing", and is a liquid that can be used, by being ejected onto a printing medium, to form images, designs and patterns, to perform a process, such as an etching process, for a printing medium, or to perform an ink process, for example, a process for solidifying, or rendering insolvable, a color material contained in ink to be ejected onto a printing medium. In other words, the term "liquid" represents any kind of ink used for printing.

2. Description of the Related Art

A printing unit, incorporated in various types of printers, copiers and facsimile machines, employs image data to be printed, and prints a dot pattern image on the surface of a printing medium, such as a paper sheet or a plastic film. Such an image forming apparatus can be classified as an ink jet printing type, a wire dot-type impact printing type, a thermal printing type and a laser beam printing type, depending on the form of the printing.

Among those types, an ink jet image forming apparatus ejects liquid droplets, such as ink droplets, onto a printing medium through an opening in a liquid ejection head, and attaches the ink to the surface of the printing medium to obtain an image. Since the ink jet image forming apparatus requires only a simple configuration, this apparatus can be provided comparatively in a small size and at a low price. Therefore, the ink jet image forming apparatus is regarded as the one that can cope with the recent demand for high-quality image output for digital cameras, and the demand for the mass printing of documents, and its use has spread rapidly.

There are some ink jet image forming apparatuses that use a liquid ejection head wherein a plurality of openings are integrated and arranged in order to increase the printing speed, or that use a plurality of liquid ejection heads to perform color printing. Furthermore, to cope with requests for high-resolution images or high-quality images, downsizing the openings and increasing the density of the openings have tended to be accelerated for the liquid ejection head. Further, to increase small printer usability, with the appearance of Li ion batteries, portable printers have begun to be sold on the market. In, for example, Japanese Patent Application Laid-open No. 9-213359(1997), a portable printer is disclosed that to perform printing also employs a fuel cell so there is no need to be concerned about the power remaining in a cell.

For portable ink jet printers or high-quality and high-performance printers, the downsizing of openings has increased, and the range of the temperature and humidity for the use of printers, including outdoor use, has been extended. Therefore, a countermeasure for drying openings has become more important. When an opening is dried, for example, water present in a liquid path communicating with the opening evaporates, the viscosity of a liquid such as ink is increased, and the solidified liquid is attached to the inner wall of the liquidpath. As a result, liquid ejection can not normally be performed, and in the worst case, the liquid ejection head must be exchanged.

Thus, in order to smoothly eject liquid droplets from an opening, there is a proposal according to which suction is applied to periodically remove liquid droplets from am opening to outside a liquid ejection head, and to discharge very viscous liquid and solidified liquid attached to the inner wall of a liquid path. Another proposal is disclosed in Japanese Patent Application Laid-open No. 10-251484 (1998), according to which water is sprayed near an opening in a liquid ejection head.

In a situation wherein an ink jet printer is connected to a home personal computer and a user employs software to shut down the OS of the personal computer and turns off the ON/OFF switch of a power outlet to reduce power consumption, the supply of power to the printer connected to the power outlet is cut off. Therefore, for a printer wherein a cap member closely covers the circumferential edge of the opening when the printer is not is use, supply of power may be cut off before the cap member has covered the opening. In this case, the opening is not fully protected by the cap member and may be dried, and it may be difficult for liquid to be normally ejected from the opening the next time the printer is used.

SUMMARY OF THE INVENTION

It is a first objective of the present invention to provide an image forming apparatus that can prevent the clogging that is caused by the drying of an opening formed in a liquid ejection head.

It is a second objective of the present invention to provide a method for humidifying in a head cap, which can prevent the clogging that is caused by the drying of an opening formed in a liquid ejection head mounted in an image forming apparatus.

To achieve the first objective, a first aspect of the present invention is an image forming apparatus for forming an image on a printing medium by using a liquid ejection head having an opening for ejecting a liquid. The image forming apparatus comprises a fuel cell for activating the image forming apparatus, a head cap for covering the circumference of the opening, and a liquid path used for introducing, into the head cap, water that is generated while the fuel cell is activated.

In the first aspect of the present invention, water generated while the fuel cell is activated is introduced to the head cap along the liquid path and causes a highly moisturizing action in the head cap, which covers the circumference of the opening in the liquid ejection head while in an unused state, and protects the opening from external air. As a result, the evaporation of a liquid present in the opening and the drying of the opening can be prevented.

a second aspect of the present invention is an image forming apparatus that includes a head cap for covering the circumference of an opening for ejecting a liquid. The image forming apparatus comprises a rechargeable battery for activating the image forming apparatus, a fuel cell for charging the rechargeable battery, and a liquid path used for introducing into the head cap water that is generated when the fuel cell is activated.

In the second aspect of the present invention, the rechargeable battery is charged by the fuel cell, and the image forming apparatus is operated by the rechargeable battery or the secondary cell. Water generated as the fuel cell is activated is introduced along the liquid path into the head cap, and produces the highly moisture retention in the head cap that covers the circumference of the opening of the liquid ejection head in an unused state, and protects the opening from external air. As a result, the evaporation of a liquid present in the opening and the drying of the opening can be prevented.

According to the image forming apparatus of the present invention, since a liquid path is provided along which water generated as the fuel cell is activated is introduced into the head cap, this water is supplied to the head cap that covers the circumference of the opening of the liquid ejection head in the unused state, and protects the opening from external air. Thus, water maintains the highly humid condition in the head cap, and the evaporation of a liquid in the opening and the drying of the opening can be prevented. Even when the image forming apparatus is not used for an extended period of time, a defect such as the clogging of the opening does not occur, and high reliability can be obtained. Furthermore, since a fuel cell is mounted therein, a small, practical use image forming apparatus can be provided. Moreover, water that is generated when the fuel cell is activated can also be effectively utilized.

In the image forming apparatus of the first or the second aspect of the present invention, the image forming apparatus may further comprise a tank for storing water that is generated when the fuel cell is activated, wherein the liquid path is in liquid communication with the tank and the head cap. In this case, as means for supplying water from the tank to the head cap, capillary action in the liquid path may be employed, the tank may be located at a higher potential head than the potential head of the head cap, or a pump may be employed.

In case that the tank is provided in which water generated when the fuel cell is activated is stored, and the liquid path is in communication with the tank and the head cap, water generated when the fuel cell is activated can be temporarily reserved in the tank.

When capillary action in the liquid path is employed as means for supplying water from the tank to the head cap, the water can be properly supplied, without requiring special power, to the head cap that covers the circumference of the opening of the liquid ejection head in the unused state and protects the opening from external air.

In case that the tank is located at a higher potential head than the head cap as means for supplying water from the tank to the head cap, the water can be properly supplied, without special power being required, to the head cap that covers the circumference of the opening of the liquid ejection head in the unused state and protects the opening from external air.

When a pump is employed as means for supplying water from the tank to the head cap, the water can be properly supplied to the head cap that covers the circumference of the opening of the liquid ejection head in the unused state and protects the opening from external air. As a result, the degree of freedom available for the layout of the head cap and the tank can be increased.

The head cap may include a flow control element which has gas permeability and liquid impermeability in order to hold a predetermined amount of water in the head cap that covers the circumference of the opening.

In case that the head cap is provided with the flow control element which has gas permeability and liquid impermeability in order to hold a predetermined amount of water in the head cap that covers the circumference of the opening, a predetermined amount of water can be properly held in the head cap that covers the circumference of the opening of the liquid ejection head in the unused state and protects the opening from external air. As a result, saturated water vapor in the head cap can be maintained, and high reliability can be provided.

The operation for positioning the head cap to cover the circumference of the opening may be performed by using power supplied by the rechargeable battery.

In this case, since the operation for positioning the head cap to cover the circumference of the opening can be completed by using power supplied by the rechargeable battery, even when, as the result of a specific cause, the image forming apparatus is suddenly powered off, the circumference of the opening can be completely covered by the head cap by using power supplied by the rechargeable battery.

A third aspect of the present invention is a method for humidifying in a head cap that covers the circumference of an opening for ejecting a liquid. The method comprises the step of introducing, into the head cap, water that is generated by operating a fuel cell that charges a secondary battery to operate an image forming apparatus.

In the third aspect of the present invention, the rechargeable battery is charged by the fuel cell and operates the image forming apparatus. Water, generated as the fuel cell is activated, is introduced into a tank and into a head cap that, when a liquid ejection head is not in use, covers the circumference of an opening and protects the opening from external air. As a result, a highly moisturizing action is obtained inside the head cap, the evaporation of a liquid present in the opening and the drying of the opening can be prevented.

According to the third aspect of the present invention for humidifying in the head cap, since water generated as the fuel cell is activated is introduced into the head cap, this water is supplied to the head cap that covers the circumference of the opening of the liquid ejection head in the unused state and protects the opening from external air. As a result, the moisture retention of the head cap can be maintained with water, and the evaporation of a liquid in the opening and the drying of the opening can be prevented. Therefore, even when an image forming apparatus is not used for an extended period of time, a defect such as clogging of the opening does not occur, and high reliability can be provided. Further, since a fuel cell is mounted therein, the size of the image forming apparatus can be reduced without the practical utility of the image forming apparatus being impaired, and water generated as the fuel cell is activated can be effectively utilized.

In the third aspect of the present invention, the method may further comprises the step of holding a predetermined amount of water in the head cap that currently covers the circumference of the opening.

In case that the method further comprises the step of holding a predetermined amount of water in the head cap that currently covers the circumference of the opening, saturated water vapor can be maintained in the head cap, so that higher reliability can be provided.

Fuel cells of solid polymer type, phosphoric-acid type, molten carbonate type and solid oxide type are well known. For this invention, a solid polymer fuel cell (PEFC) is appropriate that can be employed at a normal temperature or higher, and that does not require a heater.

The present invention provides superior effects for an ink jet image forming apparatus that comprises means, such as an electrothermal converter or a laser beam, for generating thermal energy to be used for liquid ejection and that changes the state of the liquid by using the thermal energy. This is because the method of the present invention can provide a high density and a high resolution for printing.

The present invention can also be effectively used for an image forming apparatus mounting a full line liquid ejection head that has a length corresponding to the maximum width of an available printing medium. This liquid ejection head may be a set consisting of a plurality of liquid ejection heads that provides a satisfactory length, or a single integrally formed liquid ejection head.

The present invention is also effective for an image forming apparatus, mounting a serial type liquid ejection head, that employs a liquid ejection head integrally fixed to a carriage that scans, an exchangeable head cartridge of a chip-in type that is attached to a carriage to enable an electrical connection to the carriage or the supply of a liquid from the apparatus main body, or a head cartridge wherein a tank in which a liquid is contained is integrally or exchangeably formed with a liquid ejection head.

For the image forming apparatus of the present invention, it is preferable that a recovery means, for optimizing the liquid ejection state of the liquid ejection head, and an extra auxiliary means be additionally provided in order to more stably obtain the effects of the present invention. The recovery means and the extra auxiliary means can be a unit for cleaning the liquid ejection head, a pressurizing or suction unit, pre-heating means that heats ink by using an electrothermal converter or another heating element or a combination of them, and pre-ejection means for performing ink ejection separately from printing.

The image forming apparatus of the present invention may be an output terminal for a data processing apparatus, such as a computer or an optical disk device, a copier employed together with a reader, a facsimile apparatus having a transmission/reception function, a textile printing apparatus, or an etching apparatus. The printing medium of the present invention may be a cut-sheet form or a continuous form of paper or textile, or a sheet of wood, leather, stone, resin, glass or metal, or a three-dimensional object.

The above and other objects, effects, features and advantages of the present invention will become more apparent from the following description of embodiments thereof taken in conjunction with the accompanying drawings.

DETAILED DESCRIPTION OF PREFERRED EMBODIMENTS

While referring to FIGS. 1 to 6, a detailed explanation will now be given for a serial scan ink jet printer that is an image forming apparatus according to the preferred embodiment of the present invention. However, the present invention is not limited to this embodiment, and can be variously altered or modified within the concept of the present invention cited in the claims. Therefore, the present invention can also be applied for another technique that encompasses the spirit of the present invention.

Figure 1:
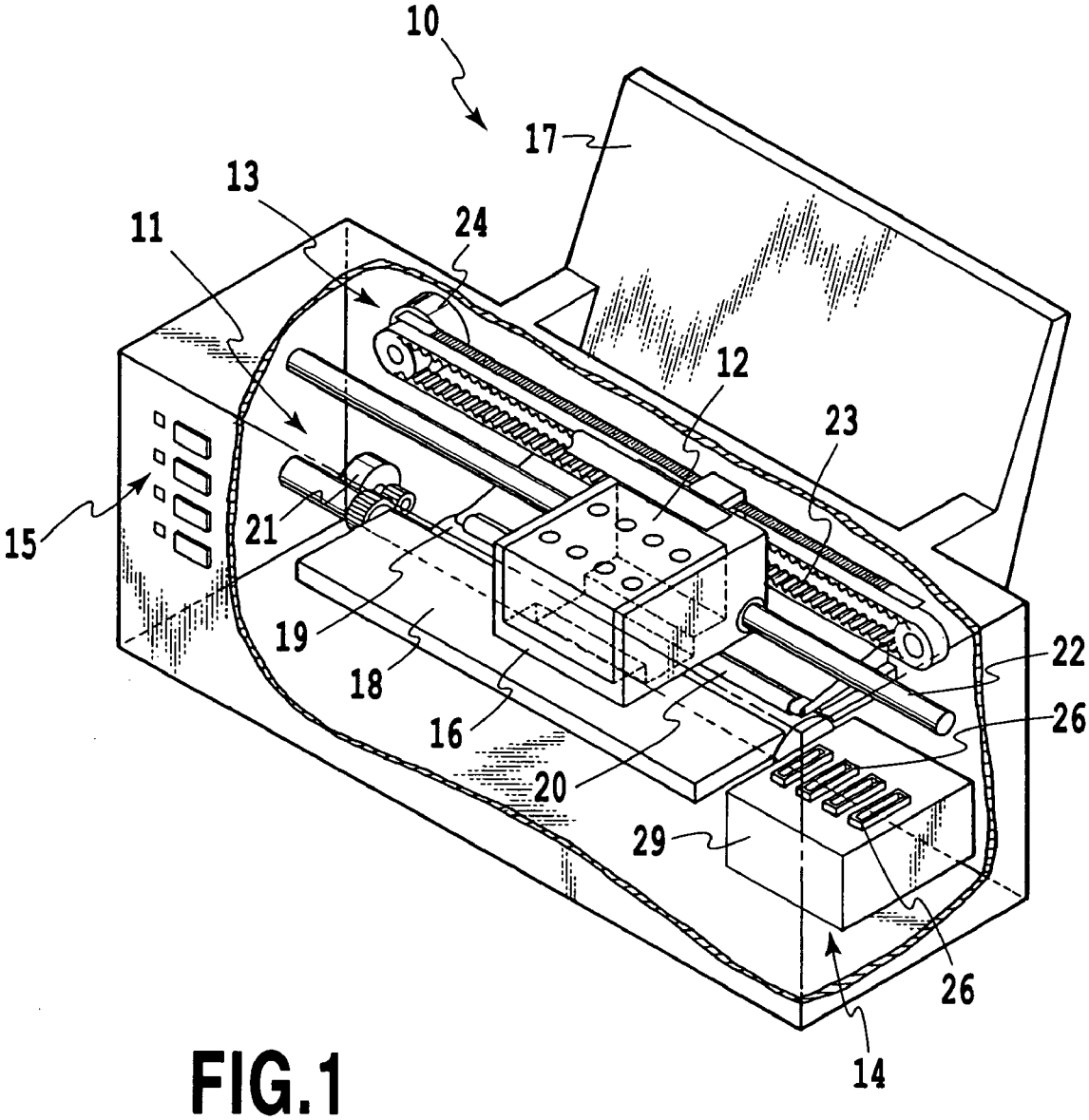
FIG. 1 is a conceptual diagram showing a serial scan ink jet printer as an image forming apparatus according to one embodiment of the present invention.

The schematic configuration of the ink jet printer for the embodiment is shown in a partially cutaway diagram in FIG. 1. In the embodiment, an ink jet printer 10 comprises a paper feeding unit 11 for feeding a paper sheet as a printing medium, a carriage driver 13 for scanning a head cartridge 12, a head recovery unit 14 for optimizing the state for the ejection of ink from orifices or openings formed in print heads, a display unit 15 for displaying the state of the ink jet printer 10, and a power source for supplying power to the paper feeding unit 11, the head cartridge 12, the carriage driver 13, the head recovery unit 14 and the display unit 15. The head recovery unit 14 also includes a function for, in the non-printing state, protecting the openings that are formed in the print heads of the head cartridge 12. The print heads are provided to the head cartridge 12, the print heads will be described later.

The head cartridge 12 is detachably mounted on a carriage 16 that is a constituent of the carriage driver 13. The head cartridge 12 is an assembly, consisting of a plurality of ink tanks in which inks, in a plurality of different colors (four colors in the embodiment, black, yellow, magenta and cyan), are contained, and a plurality of print heads to which ink from the ink tanks is supplied. The individual print heads include a plurality of openings arranged at predetermined intervals, and a plurality of ink paths that communicate with the openings. Ejection energy generators (not shown) are located along the ink paths, and include electrothermal converters for boiling ink present in the ink paths and for ejecting ink droplets from the openings.

The paper feeding unit 11 comprises a supply unit for pulling the paper sheets out, one by one, a conveying unit for conveying the paper sheets to a printing position, and a discharge unit for discharging the paper sheets from the printing position.

The supply unit includes a paper hopper 17 into which a plurality of paper sheets are inserted, and a supply roller (not shown) for pulling out at a time one sheet of the paper sheets stacked on the paper hopper 17. The conveying unit includes a feed roller 19 for intermittently conveying a paper sheet extracted from the paper hopper 17 to a platen 18, and a pinch roller 20 for sandwiching a paper sheet with the feed roller 19. In this embodiment, the platen 18 consists of a flat plate that is located at the printing position. The discharge unit includes a discharge tray (not shown) which accepts a printed sheet, a discharge roller (not shown) for discharging the printed sheet to the discharge tray, and a press roller shaped like a spur (not shown) for sandwiching a sheet with the discharge roller.

The supply roller and the feed roller 19 are rotated by a feed motor 21 through a power transmission mechanism employing gears and a chain (none of them shown).

The carriage driver 13, for ejecting ink onto the surface of a paper sheet conveyed onto the platen 18, has as a function the scanning the head cartridge 12, together with the carriage 16, in a direction perpendicular to the sheet conveying direction, i.e., in the widthwise direction of the paper sheet. The carriage driver 13 includes the carriage 16 on which the head cartridge 12 is detachably mounted, a guide rod 22 which the carriage 16 is slidably passes through, an endless timing belt 23 which extends along the guide rod 22 and is connected to the carriage 16, and a carriage scanning motor 24 which drives the timing belt 23. The guide rod 22 is extended parallel to the rotational axis of the feed roller 19 and in the widthwise direction of the paper along the platen 18. When the carriage scanning motor 24 is rotated forward or backward, the carriage 26, together with the head cartridge 12, is moved through the timing belt 23 along the guide rod 22 immediately above the platen 18. With this arrangement, together with the operation of the paper feeding unit 11, an image can be formed at a desired position on the paper.

When the head cartridge 12 is in the waiting state, i.e., when the ink jet printer 10 is not performing printing, the carriage 16 is located at the home position designated at one end of the guide rod 22 (right end in FIG. 1), and the head recovery unit 14 is also located at the home position. In the embodiment, the head recovery unit 14 includes a plurality of cap members 26 which are located opposite opening surfaces 25 of the head cartridge 12 mounted on the carriage 16, and which cover the openings in the individual print heads, a water supply mechanism for humidifying the cap members 26 that currently cover the opening surfaces 25, and a cap member elevating device 29 in which a cap moving motor 28 is assembled. The cap moving motor 28 moves the cap members 26 in the direction opposite the opening surfaces 25 on the head cartridge 12 located at the home position.

When print data are transmitted to a head driver (not shown), so that the print heads can print a paper sheet, the cap member moving unit 29 is operated to retract the cap members 26 from the head cartridge 12 located at the home position. Then, the head cartridge 12 is moved to the printing position, and printing for the paper sheet is initiated. When supply of print data to the head driver has been completed, the head cartridge 12, together with the carriage 16, is returned to the home position and the cap member elevating device 29 brings the cap member 26 into contact with the opening surfaces 25 on the head cartridge 12. Thereafter, water is supplied to the cap members 26 and a saturated water vapor is maintained inside, to suppress the drying or sticking of ink in the openings and the nearby ink paths.

Figure 2:
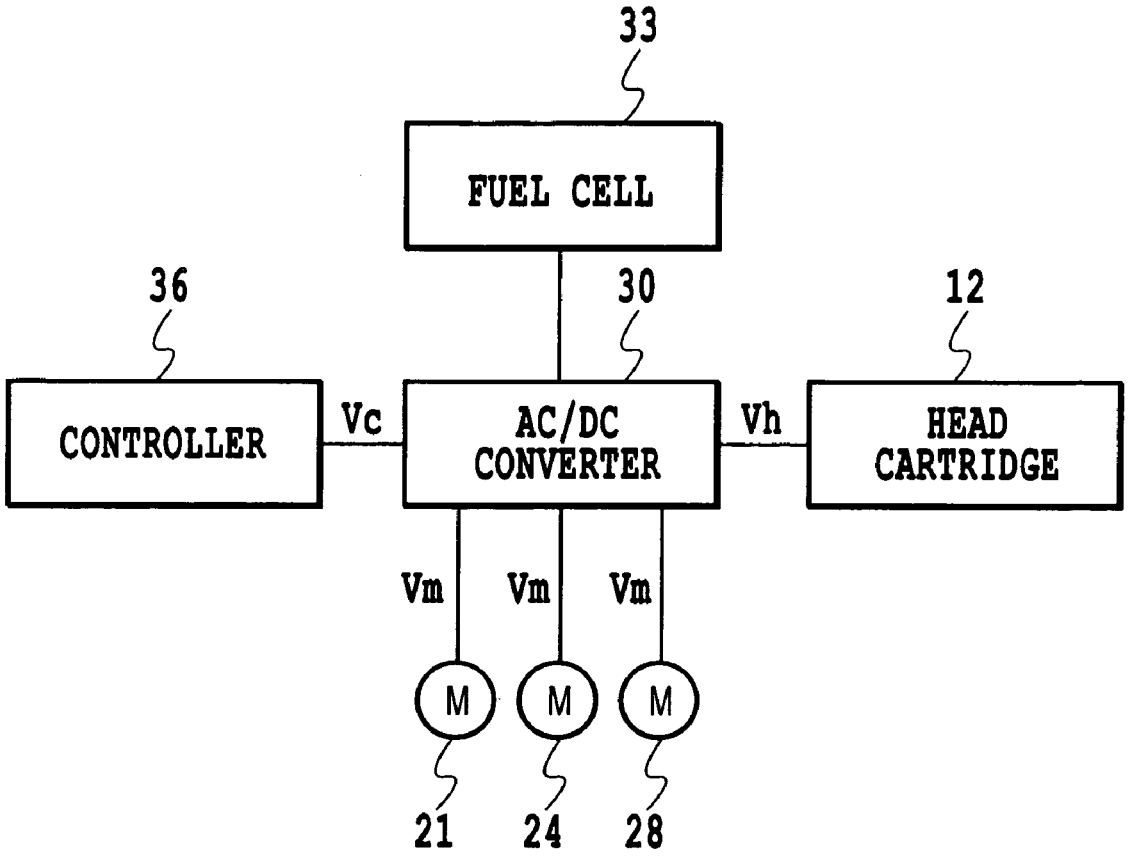
FIG. 2 is a block diagram showing an example driving system for the ink jet printer in FIG. 1.

According to the embodiment, a circuit is also provided for the ink jet printer 10 to control the paper feeding unit 11, the carriage driver 13, the head recovery unit 14 and the display unit 15. This driving system is shown in FIG. 2. In the embodiment, a fuel cell 33 is employed as the main power source for the ink jet printer 10. A voltage output by the fuel cell 33 is converted, by an AC/DC converter 30, into a motor drive voltage Vm, a print head drive voltage Vh, or a voltage Vc for a controller 36 that controls the overall operation of the ink jet printer 10. The motor drive voltage Vm is applied to the paper feeding motor 21, the carriage scanning motor 24 and the cap moving motor 28.

The controller 26 includes, for example, a CPU, an ASIC for receiving an instruction from the CPU and outputting operating signals for the motors 21, 24 and 28 and the print heads, a ROM used to store programs executed by the CPU and parameters, and a work RAM used by the CPU.

In the embodiment, the fuel cell 33 is employed as the main power source, however, a rechargeable battery may be used as the main power source while the fuel cell 33 is used as an auxiliary power source for the main power source.

Figure 3:
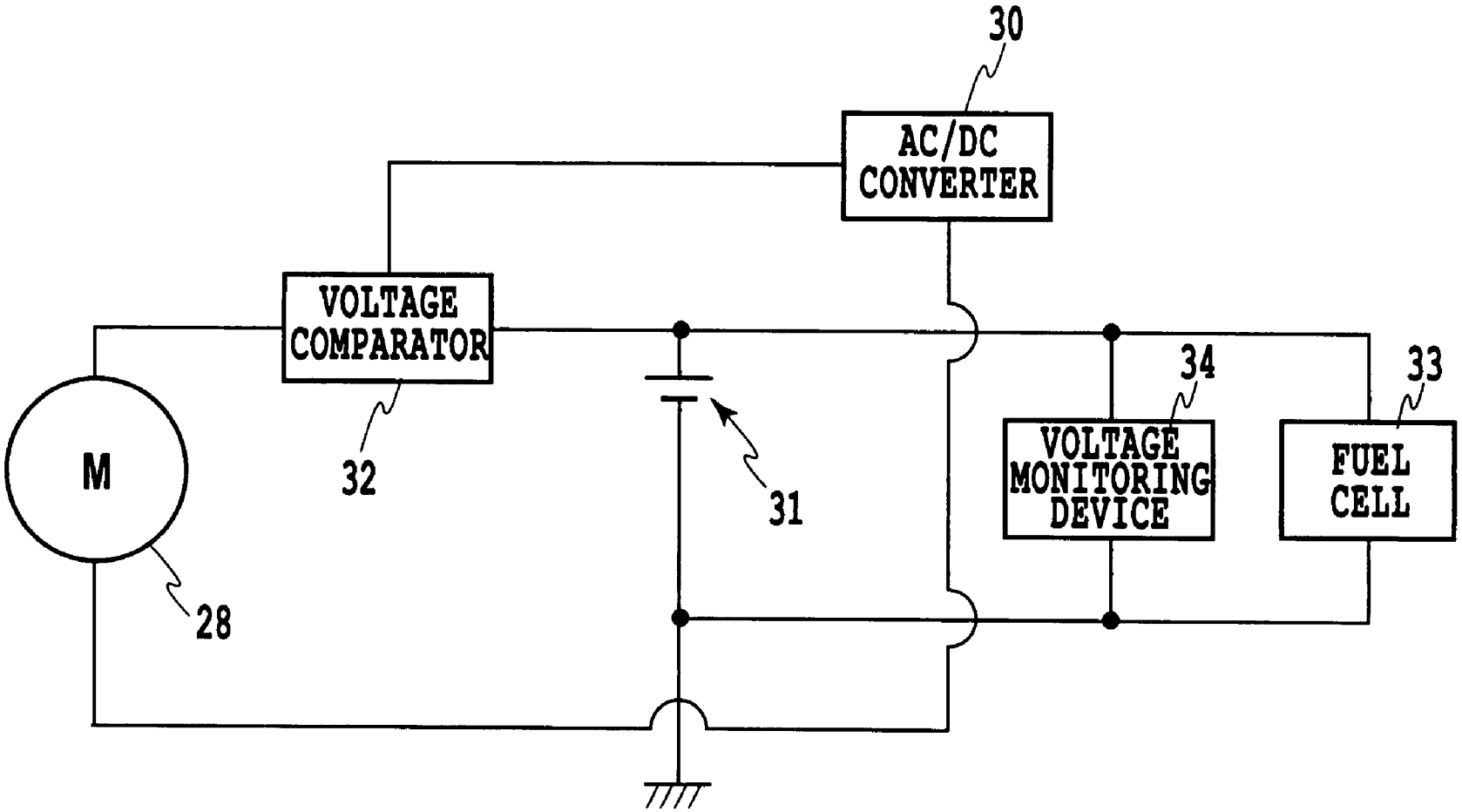
FIG. 3 is a circuit diagram showing another example driving system for the capping member of the ink jet printer in FIG. 1.

A driving system according to another embodiment of the present invention is shown in FIG. 3. The same reference numerals as are used for the above embodiment are also employed to denote corresponding components, and no further explanation for them will be given. In this embodiment, a circuit is also provided, wherein a voltage comparator 23 compares, with the voltage of a lithium ion battery 31, a DC voltage that is obtained by the AC/DC converter 30, through the conversion of an AC voltage, and that is to be applied to the cap moving motor 28. That is, when the DC voltage obtained from the AC power source is lower than the internal battery voltage, the operation of the cap members 26 can be completely performed in accordance with the state of a switch (not shown) for monitoring whether the opening surfaces 25 are fully covered with the cap members 26. It should be noted that a voltage is also applied by the AC/DC converter 30 to the controller 36 that controls the ink jet printer 10. In this embodiment, the power supplied by the lithium ion battery 31 is employed as a backup power source. With this arrangement, when due to a specific cause the AC power source for the ink jet printer 10 is suddenly turned off, power supplied by the lithium ion battery 31 can be employed to properly cover the circumferences of the openings with the cap members 26.

The power source unit for this embodiment includes a commercially available AC outlet for supplying power for home use, the lithium ion battery 31 that serves as the rechargeable battery for this invention, and the fuel cell 33 for charging the lithium ion battery 31. In this embodiment, a solid polymer film is employed as an electrolyte for the fuel cell 33. More specifically, when oxygen or air containing oxygen is supplied to an anode (air pole) and hydrogen is supplied to a cathode (fuel pole), hydrogen is ionized on the surface of the electrolyte of the cathode and electric charges are generated, while oxygen on the anode reacts with the hydrogen ionized at the cathode and water is generated. The controller 36, which has a switch circuit, is incorporated in the fuel cell 33. When a voltage monitoring device 24 detects that a DC voltage, obtained by converting the power supplied by the AC power source, is reduced and is less the internal battery voltage, and that the internal battery voltage has become equal to or is less than a rated voltage, or when in a water tank 35, which will be described later, the water level is reduced, the switch circuit of the controller 36 automatically starts the generation of electricity.

Figure 4:
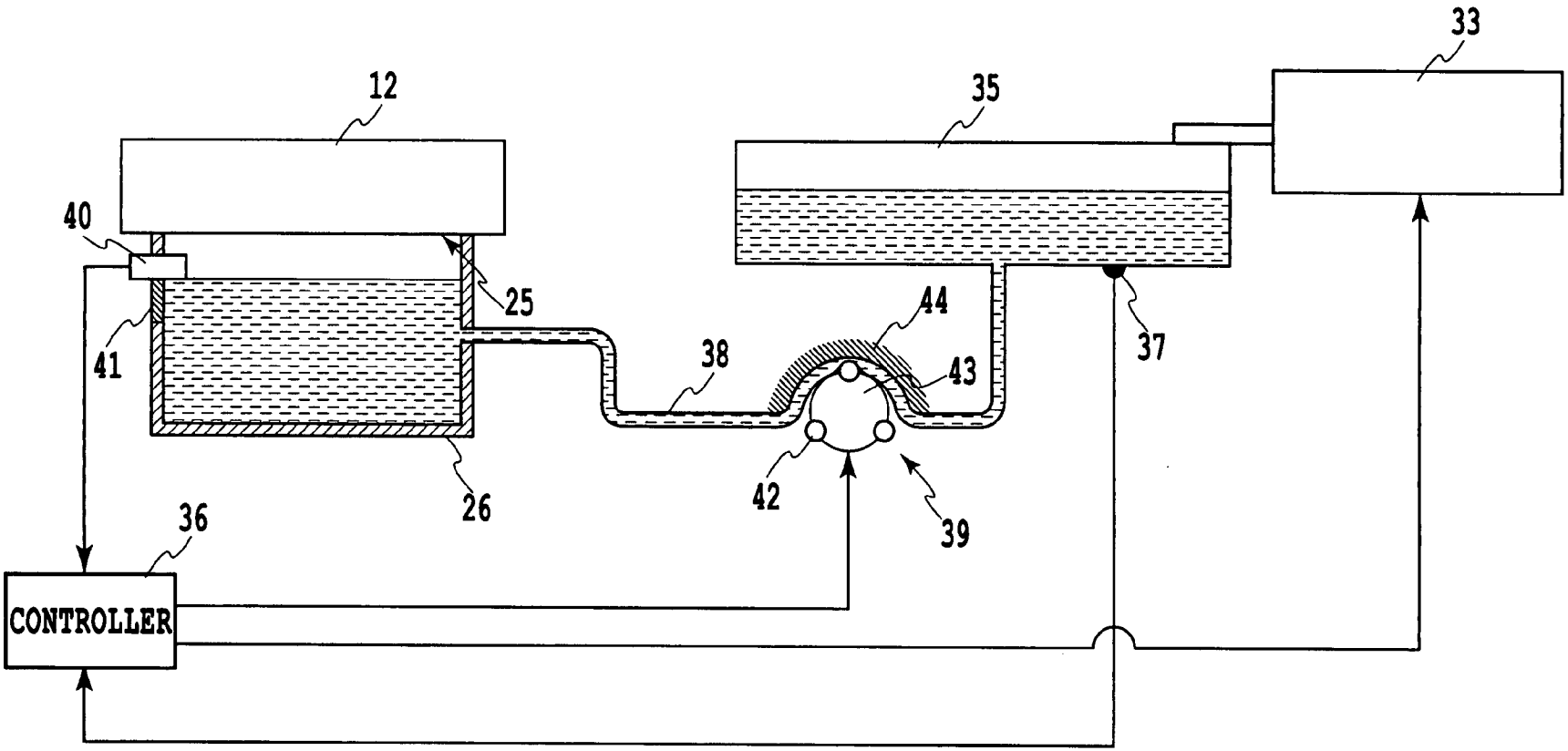
FIG. 4 is a conceptual diagram showing a water supply mechanism for the ink jet printer in FIG. 1.

The concept of the water supply mechanism in this embodiment is shown in FIG. 4. The water supply mechanism includes the water tank 35 in which water generated as the fuel cell 33 produces electricity is temporarily stored, a water level sensor 37 which is provided at the bottom of the water tank 35 to determine whether a predetermined amount of water is stored in the water tank 35, flexible water pipes 38 which are in liquid connection with the water tank 35 and the cap members 26, a tube pump 39 which supplies water from the water tank 35 along the water pipes 38 to the cap members 26, pressure sensors 40 which are attached to the cap members 26 to detect the internal pressure, and a flow control element 41 for transmitting gas and interrupting liquid. The flow control element 41 constitutes part of the cap members 26, and has gas permeability and liquid impermeability.

A detection signal obtained by the water level sensor 37 is transmitted to the controller 36, and when it is determined that no water is present in the water tank 35, the controller 36 operates the fuel cell 33 to generate and store water in the water tank 35. The tube pump 39 has a rotor 43 whereon rollers 42 are arranged along the outer edge at the same intervals. When the rotor 43 is rotated, the water pipes 38 that are held in an arched shape by a cover 44 are squeezed by the rollers 42, so that water under pressure can be sequentially supplied along the water pipes 38 to the cap members 26. Since the liquid control elements 41 are air transmitting, the air in the cap members 26 can be discharged until the elements 41 are covered with water supplied to the cap members 26. A detection signal obtained by the pressure sensor 40 is also transmitted to the controller 36. When the internal pressure of the cap members 26 reaches a predefined pressure, the controller 36 halts the operation of the tube pump 39. With this arrangement, a predetermined amount of water can be constantly maintained in the cap member 26 without moistening the opening surfaces 25 with water, while a saturated water vapor pressure is applied to the opening surfaces 25.

When water exceeding the capacity of the water tank 35 is produced by the generation of electricity by the fuel cell 33, the water tank 35 may employ a double structure, and the outer tank may be employed as an overflow tank.

In this case, it is preferable that water in the overflow tank be supplied first to the cap members 26.

In this embodiment, the tube pump 39 is employed to supply water from the water tank 35 to the cap members 26. However, a pressure head difference between the water tank 35 and the cap members 26 may be employed to supply water from the water tank 35 to the cap members 26. With this arrangement, the pressure sensor 40 and the tube pump 39, for which electricity is required, are not needed.

Figure 5:
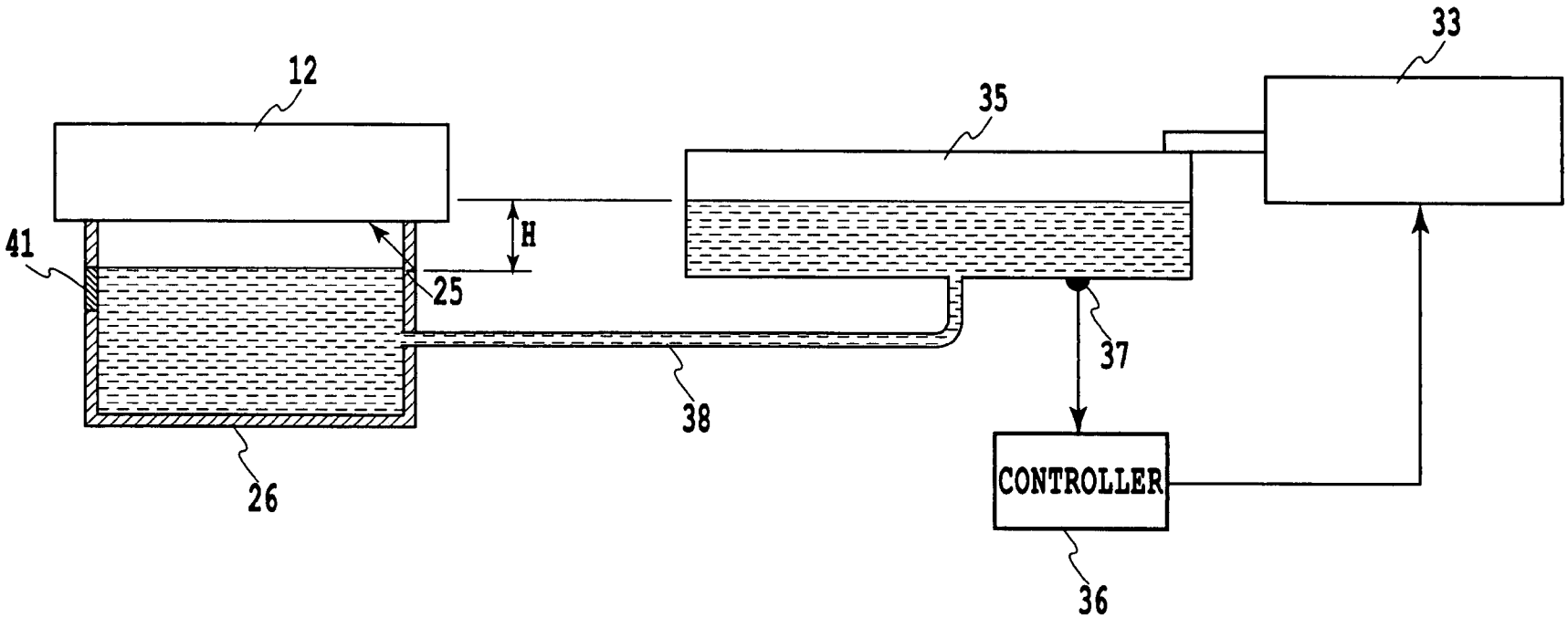
FIG. 5 is a conceptual diagram showing a water supply mechanism according to another embodiment of the present invention.

A water supply mechanism according to another embodiment is specifically shown in FIG. 5. The same reference numerals as used for the previous embodiment are used to denote corresponding components, and no further explanation for them will be given. In this embodiment, a water tank 35 is located higher than cap members 26 with a horizontal face as a reference. That is, the water tank 35 has a pressure head difference H relative to the cap members 26. Therefore, by its own weight, water in the water tank 35 is automatically supplied to the cap members 26. At this time, when the cap members 26 are located at a retracted position where the capping operation is not performed, water pipes 38 are automatically closed. In this embodiment, since the liquid control elements 41 are also provided for the cap members 26, the supply of an excessive amount of water to the cap members 26 can be avoided.

In this embodiment, the pressure difference H between the water tank 35 and the cap members 26 is used to supply water from the water tank 35 to the cap members 26. In accordance with the layout for the mechanism in the ink jet printer 10, it may be difficult to provide such a pressure head difference H. In this case, the capillary action of the water pipe 38 can be used to supply water from the water tank 35 to the cap members 26.

Figure 6:
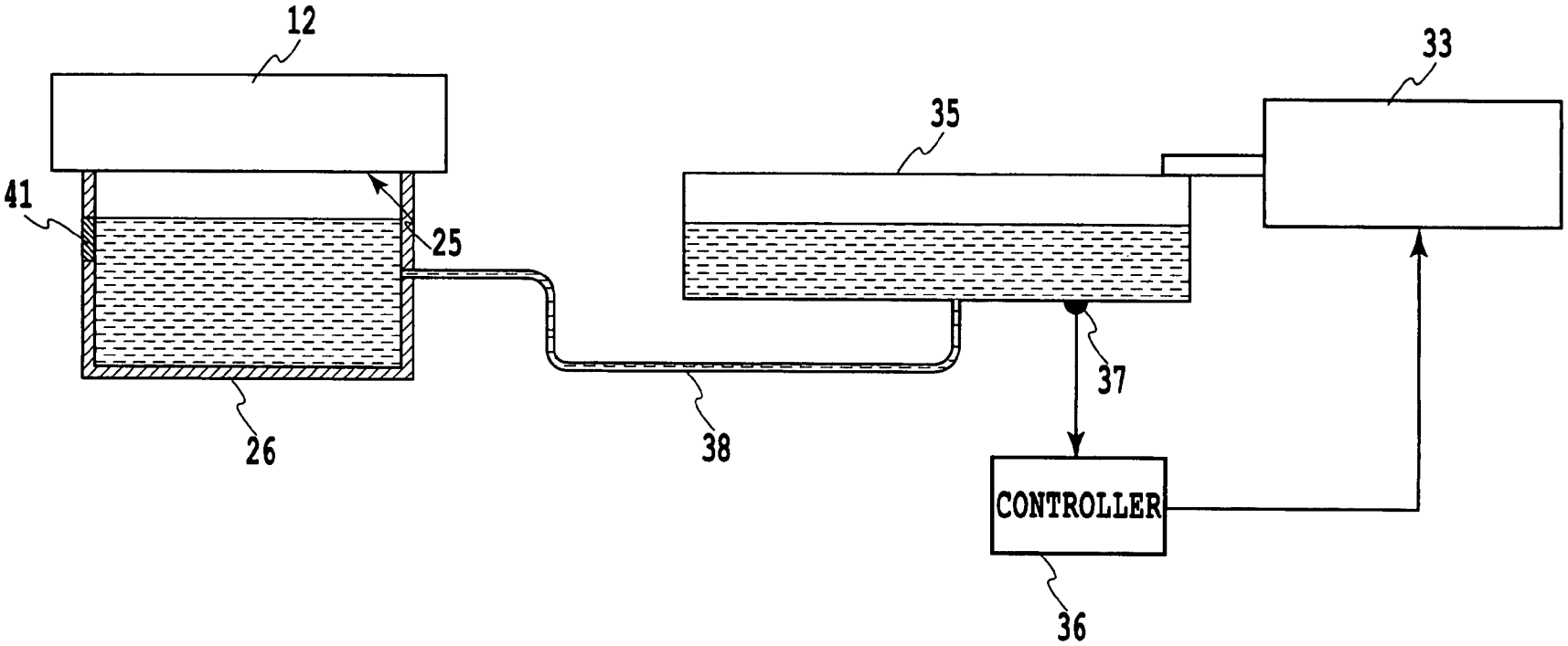
FIG. 6 is a conceptual diagram showing a water supply mechanism according to an additional embodiment of the present invention.

A water supply mechanism according to an additional embodiment is specifically shown in FIG. 6. The same reference numerals as used for the previous embodiments are also used to denote corresponding components, and no further explanation for them will be given. In this embodiment, capillary action in water pipes 38 is used to supply water from a water tank 35 to cap members 26. Therefore, so long as water is reserved in the water tank 35, water in the water tank 35 is supplied into the cap members 26 automatically by capillary action in the water pipes 38. A fabric member may be provided in the water pipes 38 to induce the capillary action, or the inner diameters of the water pipes 38 may be so small that the capillary action occurs normally. In this embodiment, since the liquid control elements 41 are also provided for the cap members 26, the supply of an excessive amount of water to the cap members 26 can be avoided. As in the above embodiment, the pressure sensor 40 and the tube pump 39, for which electricity is required, can be eliminated, and the costs for parts can be reduced.

The present invention has been described in detail with respect to preferred embodiments, and it will now be apparent from the foregoing to those skilled in the art that changes and modifications may be made without departing from the present invention in its broader aspects, and it is the intention, therefore, that the appended claims cover all such changes and modification as fall within the true spirit of the present invention.

This application claims priority from Japanese Patent Application Nos. 2003-371087 filed Oct. 30, 2003, 2004-292933 filed Oct. 5, 2004 and 2004-303457 filed Oct. 18, 2004, which are hereby incorporated by reference herein.

What is claimed is:

1. An image forming apparatus, for forming an image on a printing medium by using a liquid ejection head including an opening for ejecting a liquid, comprising:

a fuel cell for activating the image forming apparatus;

a head cap for covering a circumference of the opening;

a pressure sensor attached to the head cap;

a pump for supplying into the head cap, water that is generated while the fuel cell is activated; and a controller for controlling the pump based on information of the pressure sensor, wherein the controller controls to hold a predetermined amount of the water in the head cap that covers the circumference of the opening, to hold a saturated water vapor pressure.

2. An image forming apparatus, which includes a head cap for covering a circumference of an opening for ejecting a liquid, comprising:

a rechargeable battery for operating the image forming apparatus;

a fuel cell for charging the rechargeable battery;

a pressure sensor attached to the head cap;

a pump for supplying water into the head cap, the water being generated when the fuel cell is activated; and a controller for controlling the pump based on information of the pressure sensor, wherein the controller controls to hold a predetermined amount of the water in the head cap that covers the circumference of the opening, to hold a saturated water vapor pressure.

3. An image forming apparatus according to claim 1 or 2, further comprising:

a tank for storing the water that is generated when the fuel cell is activated; and a liquid path for introducing the water into the head cap, wherein the liquid path is in fluid communication with the tank and the head cap.

4. An image forming apparatus according to claim 3, wherein the liquid path supplies the water from the tank to the head cap through capillary action.

5. An image forming apparatus according to claim 3, wherein the pump supplies the water from the tank to the head cap through the liquid path.

6. An image forming apparatus according to claim 1 or 2, wherein the head cap includes a flow control element in order to hold a predetermined amount of the water in the head cap that covers the circumference of the opening, the flow control element having gas permeability and liquid impermeability.

7. A method for humidifying in a head cap that covers a circumference of an opening for ejecting a liquid, by introducing, into the head cap, water that is generated by activating a fuel cell that charges a rechargeable battery for operating an image forming apparatus, comprising the steps of:

detecting an internal pressure of the head cap; and controlling an amount of the water supplied in the head cap that covers the circumference of the opening based on the detected internal pressure so as to hold a saturated water vapor pressure.

* * * * *

UNITED STATES PATENT AND TRADEMARK OFFICE

CERTIFICATE OF CORRECTION

PATENT NO. : 7,300,134 B2
APPLICATION NO. : 10/971066
DATED : November 27, 2007
INVENTOR(S) : Suzuki It is certified that error appears in the above-identified patent and that said Letters Patent is hereby corrected as shown below:

ON THE TITLE PAGE:
At Item (57), Abstract, line 5, "opening" should read --openings--.

COLUMN 1:
Line 11, "ahead" should read --a head--.

COLUMN 2:
Line 15, "liquidpath." should read --liquid path.--.
Line 20, "am" should read --an--.
Line 34, "is use," should read --in use,--.

COLUMN 3:
Line 3, "a" should read --A--.

COLUMN 4:
Line 65, "comprises" should read --comprise--.

COLUMN 7:
Line 16, "which" should read --along which-- and "is slidably passes through" should read --slidably passes--.

COLUMN 8:
Line 4, "controller 26" should read --controller 36--.
Line 53, "less the" should read --less than the--.

Signed and Sealed this

Thirty-first Day of March, 2009

John Doll

JOHN DOLL
*Acting Director of the United States Patent and Trademark Office*